US008696478B2

(12) United States Patent
Kapsalis et al.

(10) Patent No.: US 8,696,478 B2
(45) Date of Patent: Apr. 15, 2014

(54) DASHER BOARD ASSEMBLY

(75) Inventors: Marc Kapsalis, Elmhurst, IL (US); Erzabeth J. Fekete, Belgrade, ME (US); Melanine Anne Ouellette, Huntersville, NC (US); Ian Jensen Gillerman, Rehoboth, MA (US); Aren Yale Paster, Ballston Spa, NY (US); Mark Walter Steiner, Slingerlands, NY (US); Andrew S. Miller, New Hartford, NY (US)

(73) Assignee: Marc Kapsalis, Elmhurst, IL (US)

( * ) Notice: Subject to any disclaimer, the term of this patent is extended or adjusted under 35 U.S.C. 154(b) by 15 days.

(21) Appl. No.: 13/507,062

(22) Filed: May 31, 2012

(65) Prior Publication Data

US 2013/0040745 A1 Feb. 14, 2013

Related U.S. Application Data

(60) Provisional application No. 61/521,979, filed on Aug. 10, 2011.

(51) Int. Cl.
*A63C 19/00* (2006.01)

(52) U.S. Cl.
USPC ..... 472/94

(58) Field of Classification Search
USPC ..... 472/94
See application file for complete search history.

(56) References Cited

U.S. PATENT DOCUMENTS

| | | | | |
|---|---|---|---|---|
| 2,808,136 | A | 10/1957 | Hammitt et al. | |
| 3,727,888 | A * | 4/1973 | Nickolas | 256/24 |
| 3,986,342 | A | 10/1976 | MacCracken | |
| 4,927,134 | A | 5/1990 | Burley | |
| 5,706,625 | A * | 1/1998 | Vallance et al. | 52/766 |
| 5,953,882 | A | 9/1999 | Vallance et al. | |
| 6,004,217 | A * | 12/1999 | Johnston et al. | 472/92 |
| 6,783,461 | B2 * | 8/2004 | Frazier et al. | 472/92 |
| 7,914,385 | B2 | 3/2011 | Palumbo et al. | |
| 2005/0196570 | A1 | 9/2005 | Lindsay | |
| 2009/0137329 | A1 * | 5/2009 | Palumbo et al. | 472/94 |

FOREIGN PATENT DOCUMENTS

| | | |
|---|---|---|
| CA | 2708199 | 1/2012 |
| CH | 645275 A5 | 9/1984 |

* cited by examiner

*Primary Examiner* — Michael Dennis

(57) ABSTRACT

A dasher board assembly, particularly well-suited for an ice hockey rink, includes a number of advantageous structures including an ice dam (ice retainer), puck rebound facilitator backing a kickplate, and a unitary rigid L-shaped anchoring device for the dasher board frame. The ice dam has a main body component and a lip upstanding from the body a distance sufficient to assist in blocking moisture movement past the dasher board and to provide an open space. The rigid L-shaped anchoring device is connected by fasteners to vertical elements of the dasher board frame, and to the ice dam body, to provide stable mounting of the frame. The puck rebound facilitator may be a buckling elastomeric tube that is essentially rigid when a hockey puck impacts the kickplate but buckles to absorb the force of impact if a hockey player strikes the dasher board.

11 Claims, 9 Drawing Sheets

DASHER BOARD ASSEMBLY

CROSS-REFERENCE TO RELATED APPLICATION

This application is related to U.S. Provisional Application Ser. No. 61/521,979 filed Aug. 10, 2011, the priority of which is claimed and the disclosure of which is incorporated by reference herein.

BACKGROUND AND SUMMARY OF THE INVENTION

Many areas for playing sports or engaging in recreational activities, such as ice and inline hockey rinks, roller skating rinks, indoor soccer fields, indoor football fields, short track (or other) speed skating rinks, and indoor handball fields, have an exterior perimeter defined by wall panels. These wall panels are often referred to as "dasher boards," particularly in ice hockey and short track speed skating rinks. If a participant within such an area contacts the dasher boards at high speed, with high energy, and/or in an awkward position, serious injuries can result including concussions and neck and spinal cord injuries.

In the above-mentioned provisional application, and as provided and claimed in a co-pending U.S. utility application with overlapping inventors entitled ENHANCED SAFETY DASHER BOARD ASSEMBLY, a dasher board assembly is disclosed in which participant safety is enhanced by providing flexible cantilevered substantially vertical frame elements for supporting dasher boards and/or by providing a dampening material of particular characteristics (e.g. with at least one of a damping coefficient of about 1.7-3.2×$10^4$ Newton seconds per meter, a spring constant of about 1.5-3.0×$10^6$ Newtons per meter, and a loss coefficient, $\eta$>0.15) between the dasher board and the frame. According to the present invention various accessory structures are provided which augment the functionality of the enhanced safety assembly mentioned above especially (although not exclusively) for ice rinks.

The invention, when combined with the enhanced safety structure set forth above, achieves the desired level of protection to prevent or minimize the severity of concussions when high speed and/or energy dasher board impacts occur. Concussions almost universally occur if the Head Injury Criteria (HIC-14) is 250 or more. HIC is determined by the following formula:

$$HIC = \left\{(t_2 - t_1)\left[\frac{1}{t_2 - t_1}\int_{t_1}^{t_2} a(t)dt\right]^{2.5}\right\}\max$$

The enhanced safety dasher board assembly described above, in cooperation with the features of the invention, reduces HIC (compared to a rigid dasher board frame assembly) by at least 30%, and typically by more than about 60%, at virtually all practical impact speeds and energy levels at substantially any portion of a dasher board. For virtually every realistic scenario HIC is less than 250, often less than 50.

According to one aspect of the present invention a dasher board assembly for an ice rink or the like is provided comprising a frame and at least one substantially rigid dasher board operatively attached to the frame and having a top area and bottom area. An ice dam (also known as an "ice retainer") is provided at or adjacent the bottom area. As opposed to conventional ice dams which typically are simply a block of HDPE or steel (as shown by structure "9" in FIG. 1 of U.S. Pat. No. 5,953,882, for example), the ice dam according to the invention provides enhanced ability to isolate dasher board assembly components from ice in the rink, and deal with condensation which may occur opposite the ice from the dasher board. The ice dam of the invention comprises a main body component and a lip extending upwardly a significant distance from the main body component. The lip underlies the dasher board and the main body component underlies the frame. The "significant distance" is preferably between about ½ and two ½ inches, e.g. about one inch.

Indicia (printed, painted, etched, etc.) may be provided on the ice dam on the surface facing the rink interior indicating a water/ice fill level. The ice dam may have a unitary construction (e. g. solid HDPE), or the lip and the main body component may comprise two separable elements (e.g. of steel or HDPE), held together with mechanical fasteners.

The assembly described above may also include a kickplate operatively connected to the dasher board at the bottom area thereof on the opposite side of the dasher board from the frame. A dampening material (as described in the provisional and co-pending utility applications) is operatively provided between the dasher board and the frame elements; and according to the invention a puck rebound facilitating structure operatively engages the dasher board at the general area of the kickplate. The puck rebound facilitating structure exhibits the dual functions of high energy absorption upon impact of the dasher board by a high mass object at a relatively low speed (e. g. a hockey player travelling at 10 mph) and minimal energy absorption upon impact of the kickplate by a hockey puck (e. g. a six ounce puck at high speed, sometimes in excess of 100 mph). For example the structure could comprise a buckling elastomeric tube, with a number of spaced such structures provided.

The ice dam lip defines an open space beneath the structure so that any ice buildup due to condensation on the frame side of the dasher board will not adversely impact the functionality of the puck rebound facilitating structure. The open space also prevents ice buildup that would reduce the functionality of dampening material provided between the dasher board and frame, and interspersed between puck rebound facilitating structures.

Also according to the invention the assembly described above may further comprise a rigid unitary L-shaped anchoring device for the frame having a substantially horizontal leg operatively connected to the ice dam body component and a substantially upright leg operatively connected to the frame. For an ice hockey rink preferably the upright and horizontal legs each have a width of about three-five (e. g. about four) inches, and a thickness of about 0.4-0.6 (e. g. about 0.5) inches. Desirably the upright leg is connected to at least two substantially vertical frame elements by mechanical fasteners.

According to another aspect of the invention a dasher board assembly for an ice hockey rink or the like is provided. The assembly comprises: a frame including a plurality of substantially vertical frame elements and a plurality of substantially horizontal frame elements; at least one substantially rigid dasher board operatively connected to the vertical and horizontal frame elements, the dasher board having a top area and bottom area; a dampening material between said frame and board; a kickplate operatively connected to said bottom area; and a buckling elastomeric tube. The dampening material preferably has at least one of a damping coefficient of about 1.7-3.2 (e.g. about 2.7)×$10^4$ N−s/m, a spring constant of about 1.5-3.0 (e. g. about 2.4)×$10^6$ N/m, and an $\eta$·value>0.15 (e.g.

>0.25), and the buckling tube has generally comparable values when the board is impacted by a high mass object at relatively low speed.

According to yet another aspect of the present invention a dasher board assembly is provided comprising: a frame including a plurality of substantially vertical frame elements and a plurality of substantially horizontal frame elements; at least one substantially rigid dasher board operatively connected to the substantially vertical and horizontal frame elements; and a unitary rigid L-shaped anchoring device (e.g. of aluminum or steel) for the frame having a substantially horizontal leg operatively connected to a stationary surface and a substantially upright leg operatively connected to at least two of the frame substantially vertical elements. Desirably the upright leg is connected to two substantially vertical frame elements by mechanical fasteners.

The anchoring device may be used with dasher board assemblies for any type of enclosure, not just ice rinks. However, when used for an ice rink desirably the upright and horizontal legs each have a width of about three-five (e. g. about four) inches, and a thickness of about 0.4-0.6 (e.g. about 0.5) inches, and the assembly further comprises an ice dam surface between the anchoring device substantially horizontal leg and the stationary surface, the anchoring device operatively connected to the ice dam surface (e. g by mechanical fasteners).

It is the primary object of the present invention to provide a dasher board system with enhanced functionality in a number of areas. This and other objects of the invention will become clear from the detailed description of the invention, and from the appended claims.

DETAILED DESCRIPTION OF THE DRAWINGS

Figure 1:
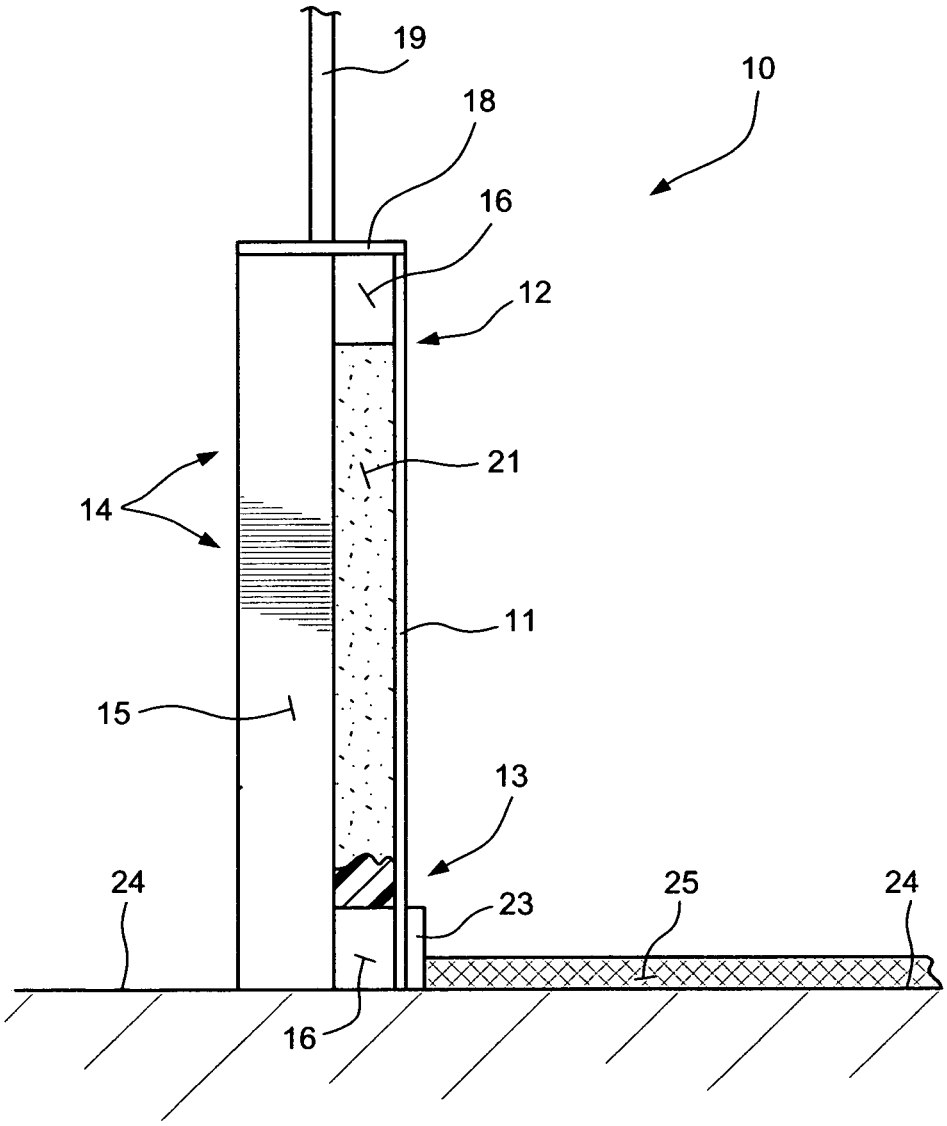
FIG. 1 is schematic side view, mostly in elevation and partly in cross-section, of an exemplary dasher board assembly with which the present invention may be utilized.

The exemplary dasher board assembly 10 in FIG. 1, and in all other embodiments, utilizes conventional dasher boards 11. The dasher boards 11 may be made of any conventional or hereafter developed material, such as the materials described for "facing panels" in column 5 of U.S. Pat. No. 7,914,385 including, but not limited to, HDPE, thermoplastic elastomer polyolefin, fiberglass, plywood, or other substantially rigid (compared to the dampening material to be hereinafter described) material. The dasher boards 11 may be of any suitable size (length, width and thickness) and are typically substantially planar, although they can be curved (or are flexible enough to be curved) for corners of the rink, playing field, or recreational area that they define at least part of the perimeter of.

The boards 11 have a top area or portion 12 and a bottom area or portion 13, and are disposed substantially vertically during use.

The assembly 10 also includes a frame, shown generally by reference numeral 14 in FIG. 1, to which the boards 11 are operatively attached. The frame 14 typically includes a plurality of substantially vertical frame elements 15 (only one of which is shown in the side view of FIG. 1) and one or more substantially horizontal frame elements 16. Although not significant for the distinctions of the invention over the prior art, the frame 14 also typically includes a conventional top bumper 18 and has conventional components (not shown) for mounting one or more transparent upper shielding panes 19 of any suitable conventional material such as tempered glass, acrylic, or Plexiglas.

One feature of the assembly 10 is the provision of a dampening material, shown schematically at 21 in FIG. 1, between at least some, and preferably all, of the frame elements 15, 16 and the dasher board 11. The dampening material 21 must have very significant impact energy absorbing characteristics, much more significant than (e.g. at least three times greater than) that provided by an acrylic foam tape substrate. The material 21 desirably has at least one of a damping coefficient of about 1.7-3.2 [e.g. about 2.7]$\times 10^4$ N–s/m, a spring constant of about 1.5-3.0 [e.g. about 2.4]$\times 10^6$ N/m, and a loss coefficient>0.15. Two examples of materials that may provide that function are rebond foam and type 1850 foam, each having a thickness of about 2.5-4 inches and an $\eta$ value>0.15. Other suitable compressible materials for the dampening material 21 are described in the aforementioned utility application.

While FIG. 1 shows the dampening material of substantially constant thickness throughout, it may have different thicknesses in different areas. For example material 21 could have a slightly different thickness near the bottom area 13 of the board 11 than at the top area 12. Alternatively a dampening material 21 with different spring constant and/or damping coefficient and/or $\eta$ value could be provided at or near the bottom area 13 than at or near the top area 12.

It is highly desirable to provide the dampening material 21 substantially continuously (although not necessarily completely, that is covering at least about 75-95%) between the frame 14 and dasher board 11 rather than at widely spaced discrete locations. Also it is desirable that the material 21 comprise a compressible material rather than mechanical elements such as coil springs. A substantially continuous material has the advantages of ease of construction and use, longevity, precise functionality at all locations, and others.

The assembly 10 may have any other desirable conventional components, such as an ice dam (not shown) if the assembly defines the perimeter of an ice hockey or short track speed skating rink, kickplate 23, and bolts and/or other hardware (not shown) for mounting at least the substantially vertical frame elements 15 to a floor 24 or ground surface on the opposite side of the dasher board 11 from the ice 25 or other playing or recreational surface.

Figure 2:
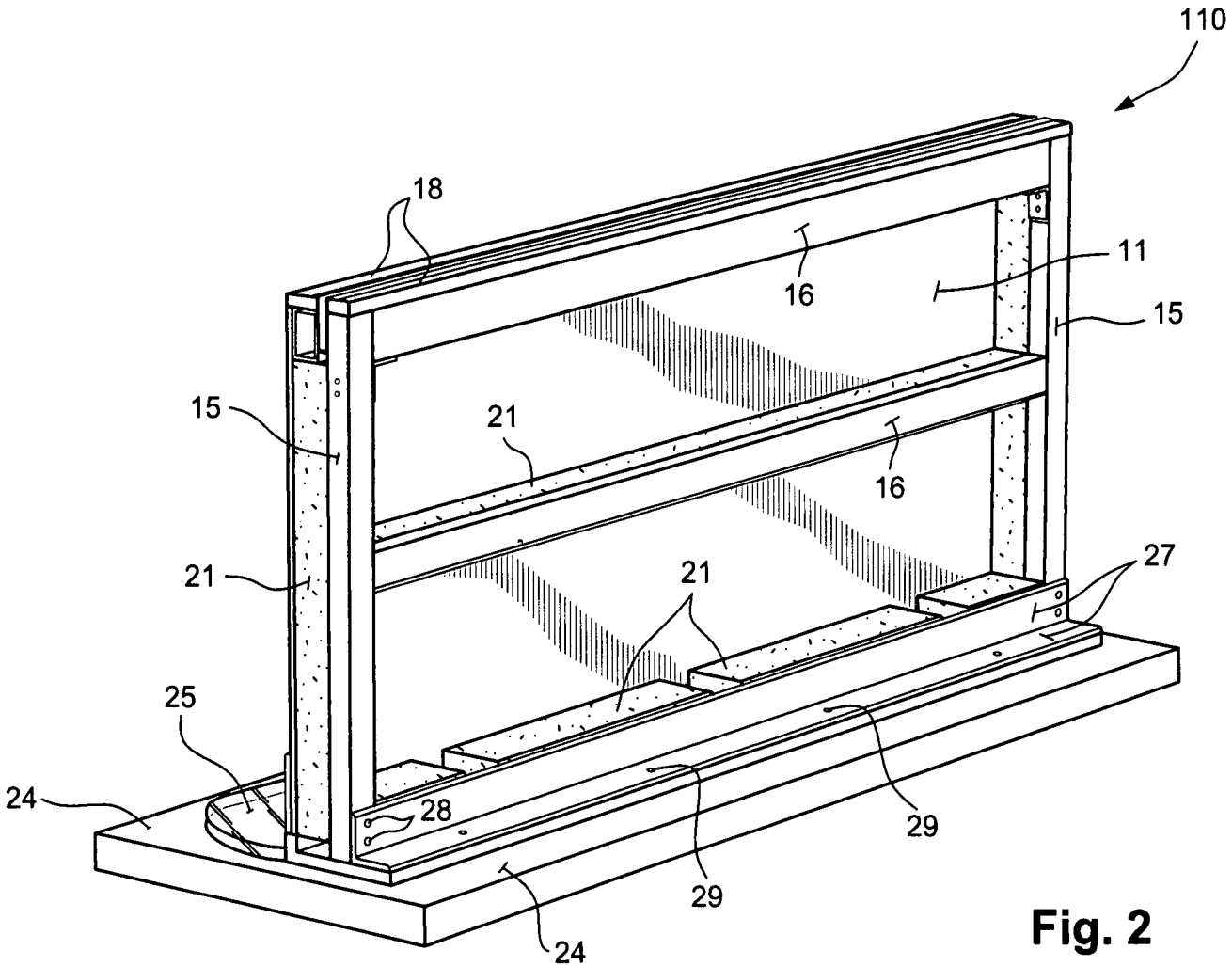
FIG. 2 is a more detailed rear isometric view of one section of an exemplary dasher board assembly with the transparent shielding panel removed and including a particular ice dam and frame anchoring device according to the invention.

FIG. 2 shows, from the rear, a more detailed assembly 110, reference numerals in this embodiment being the same for comparable components in the FIG. 1 embodiment. The assembly 110 is just one section, having at least one dasher board 11, which section will be connected together with other like sections in a conventional manner (or as described with respect to FIG. 10) to define a perimeter of a rink, playing field, or recreational area. The assembly 110 has upper and middle substantially horizontal frame elements 16, two substantially vertical frame elements 15 at opposite sides thereof, and dampening material (e. g. foam) 21 along most of the lengths of the frame elements 15, 16.

The assembly 110 also includes, according to the invention, a desirable frame anchoring device in the form of a rigid angle iron or other unitary L-shaped element 27. Element 27 has a substantially upright leg and a substantially horizontal leg.

The upright leg of element 27 is connected by bolts or screws—shown schematically at 28 in FIG. 2—or other mechanical fasteners [or by permanent fixing structures in a permanent facility] to the bottom portions of the frame elements 15. The horizontal leg of element 27 is connected by other mechanical fasteners 29 to the floor 24 or other stationary structure. Element 27 may be of any suitable material, such as steel or aluminum. The element 27 according to the invention has numerous advantages over conventional mounting of a dasher board frame to a floor including, but not limited to, sturdiness of construction.

Figure 8:
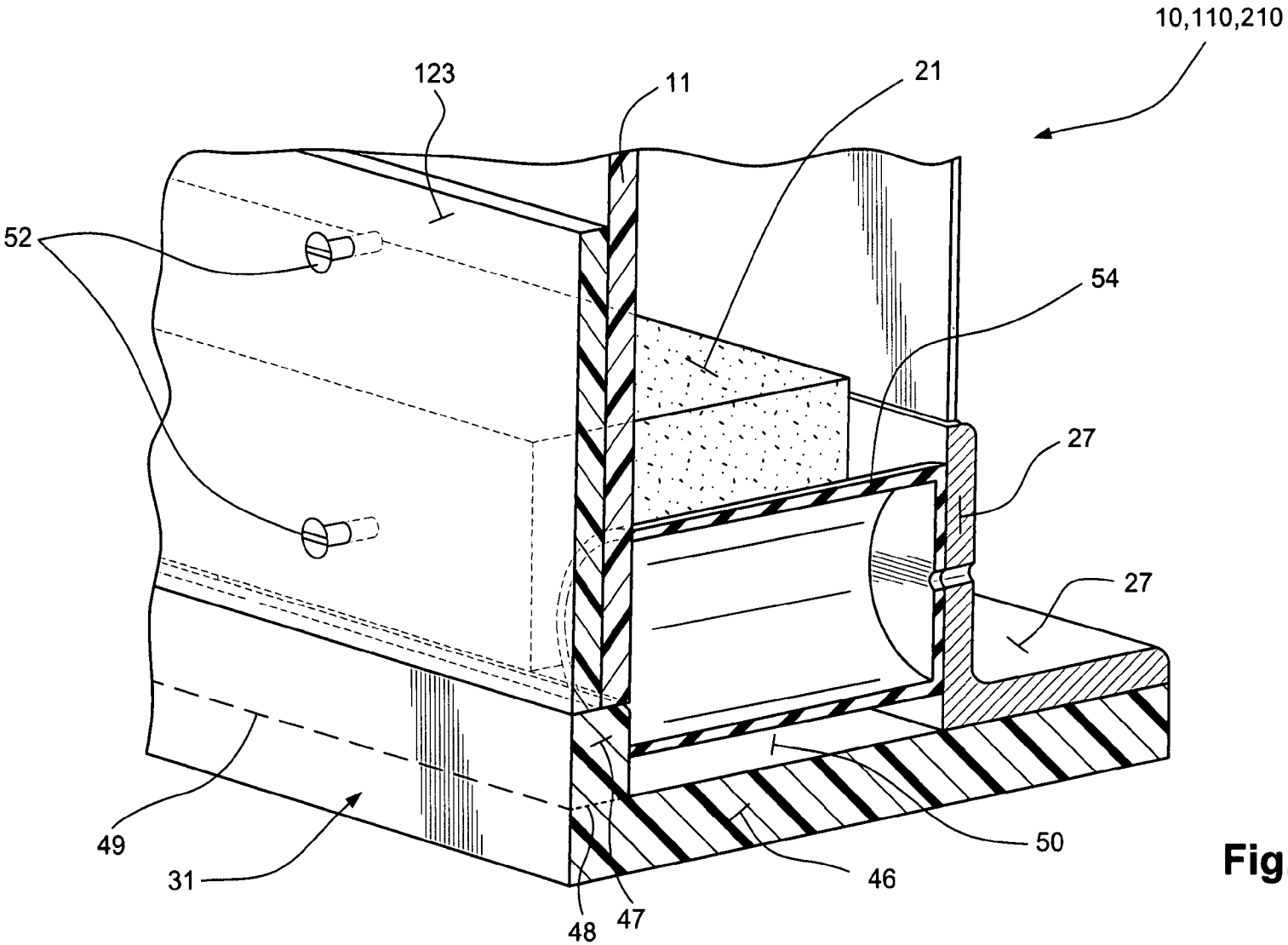
FIG. 8 is a detailed perspective view, with most components shown in cross-section, of exemplary ice dam, kick-plate, frame anchoring, and puck rebound facilitating elements according to the present invention.

FIG. 2 also shows a particular configuration of an ice dam 31 according to the invention (hereafter described with respect to FIG. 8). Ice dam 31 forms a base for the elements 15, 27 and the fasteners 29 pass through it to connect the assembly 110 to the floor 24.

While dimensions of the components may vary, in a conventional situation where the boards 11 have a height of about forty inches (for a conventional ice hockey rink) the legs of the L-shaped element 27 desirably each have a width of about three-five (e. g. about four) inches, and a thickness of about 0.4-0.6 (e. g. about 0.5) inches.

While the frame elements 15 may have a wide variety of configurations, such as spring steel planar or curved plates, bars, or tubes, desirably the elements 15 comprise polygonal (preferably quadrate) cross-section aluminum tubes. Since tubes 15 are polygonal in cross-section there will be a substantially flat surface which the dampening material 21 abuts (and preferably another flat surface abutting the upright leg of element 27), and the cantilever mounting thereof will result in the ability of the elements 15 to deflect to absorb energy when the upper area 12 of the board 11 is impacted.

One particularly desirable material for the elements 15 comprises AL 6061 T6 rectangular hollow tube extrusions. This material will provide approximately a two-four (e. g. about three) inch deflection when the topmost area 12 of the board 11 receives a maximum probable impact, absorbing the majority of the energy of the impact, while the dampening material (e. g. foam) 21 also absorbs some energy.

That is, the vertical supports 15 act as a pair of cantilever beams.

Figure 3:
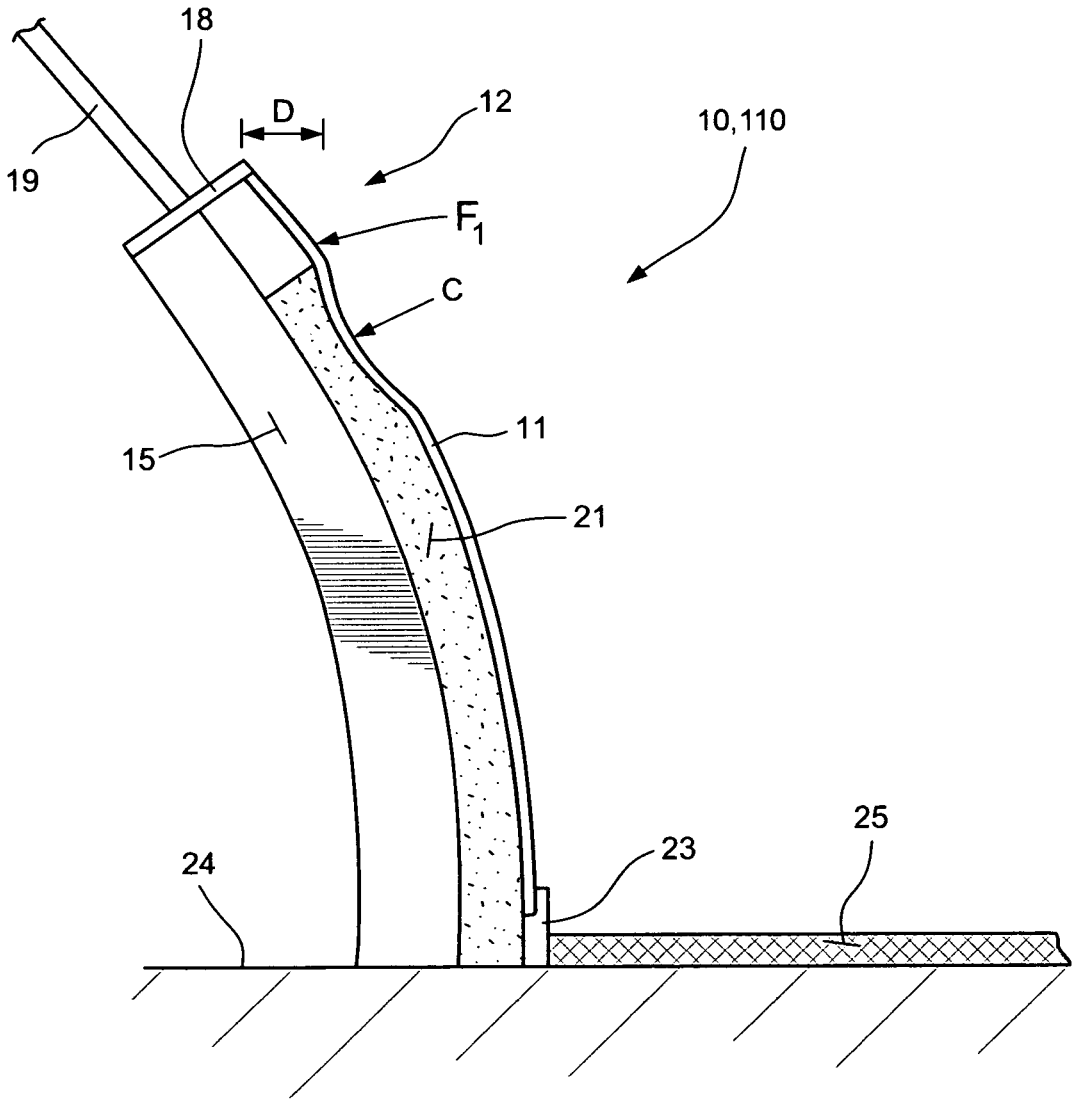
FIG. 3 is a side schematic view of the assembly of FIG. 1 showing, in exaggerated form, the deflection of the cantilevered substantially vertical frame elements and compression of the dampening material when the illustrated dasher board is subjected to an impact force $F_1$ near the top thereof.
Figure 4:
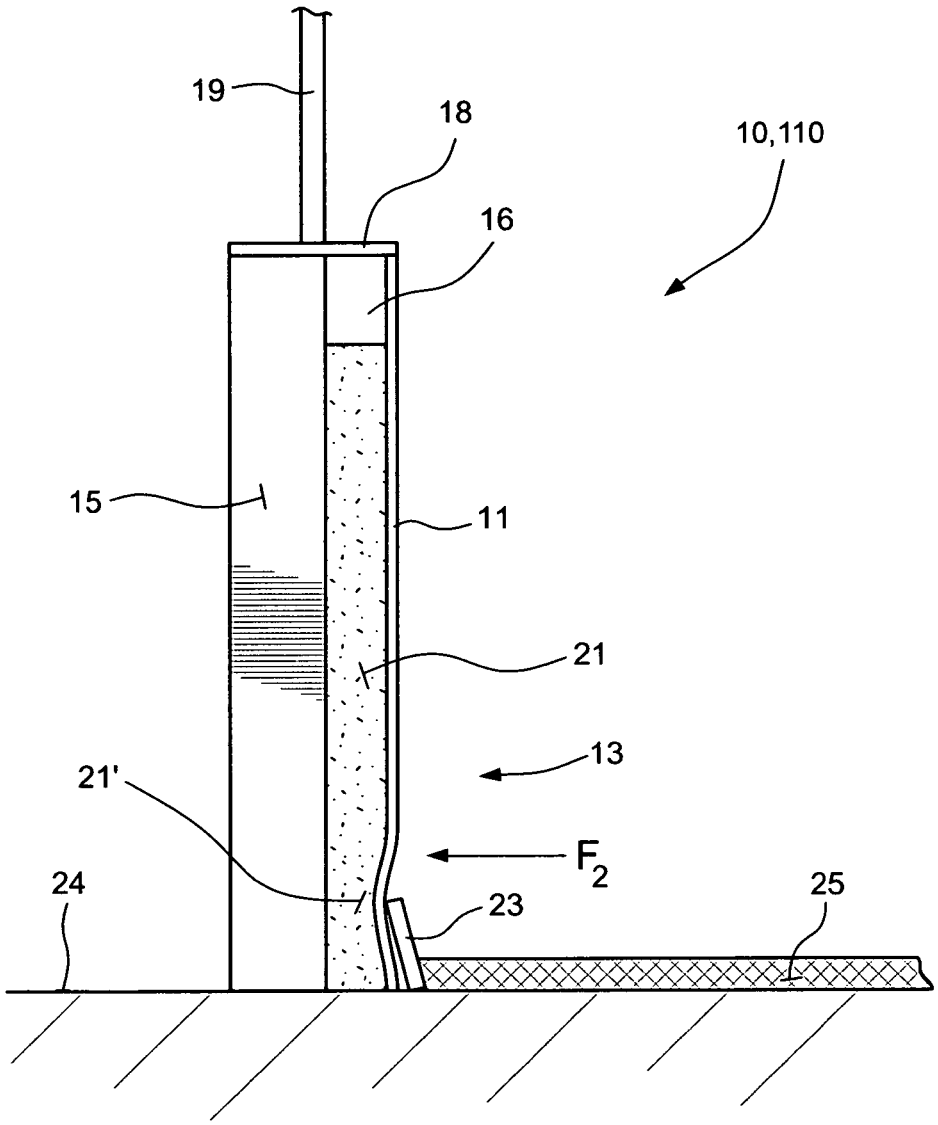
FIG. 4 is a view identical to that of FIG. 3 showing compression of the dampening material when the dasher board is subjected to an impact force $F_2$ near the bottom thereof.

FIGS. 3 and 4, in a schematic and exaggerated manner for demonstrative purposes, illustrate the functionality of an assembly 10, 110 when subjected to large forces, such as professional ice hockey players impacting the board 11 at speeds up to 30 mph.

FIG. 3 illustrates the situation wherein the impact force $F_1$ is at or near the upper area 12 of the board 11 (assumed to have a conventional height of about forty inches). The force $F_1$ is absorbed primarily in a first mode of absorption, namely by the deflection of one or more of the vertical frame elements 15, the deflection D being about three inches. Also, some compression of the dampening material (e. g. foam) 21 may or will also take place, as indicated by C in FIG. 3, providing a second mode of absorption and thus absorbing some of the energy of the force $F_1$.

As seen in FIG. 4 where the force $F_2$ is applied at the bottom area 13 of the board 11 the force will be absorbed primarily (or essentially exclusively) by the second mode, namely the compression of the dampening material (e. g. foam) 21. This is schematically illustrated in FIG. 4 by the compressed portion 21' of the material 21.

The assemblies 10, 110 function to insure an MC of less than 250 (and often less than 50) for all practical scenarios that would be encountered in an ice hockey game or other activity. The assemblies 10, 110 reduce the HIC by at least 30% compared to dasher board assemblies with rigid frames, and typically by more than about 60%.

Figure 5:
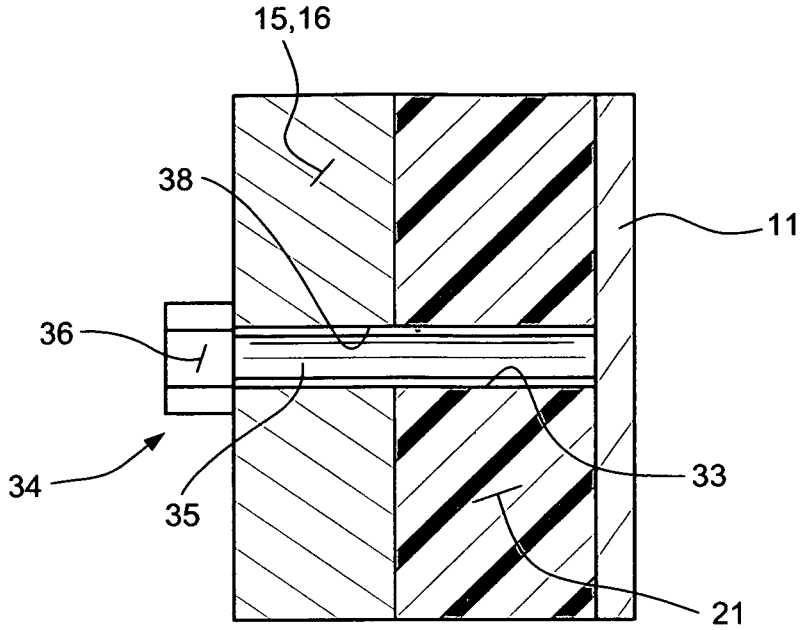
FIG. 5 is a schematic detailed cross-sectional view, with one element in elevation, of the dasher board assembly of FIG. 1 in its normal configuration at a location where a mechanical fastener connects the dasher board to a frame element.
Figure 6:
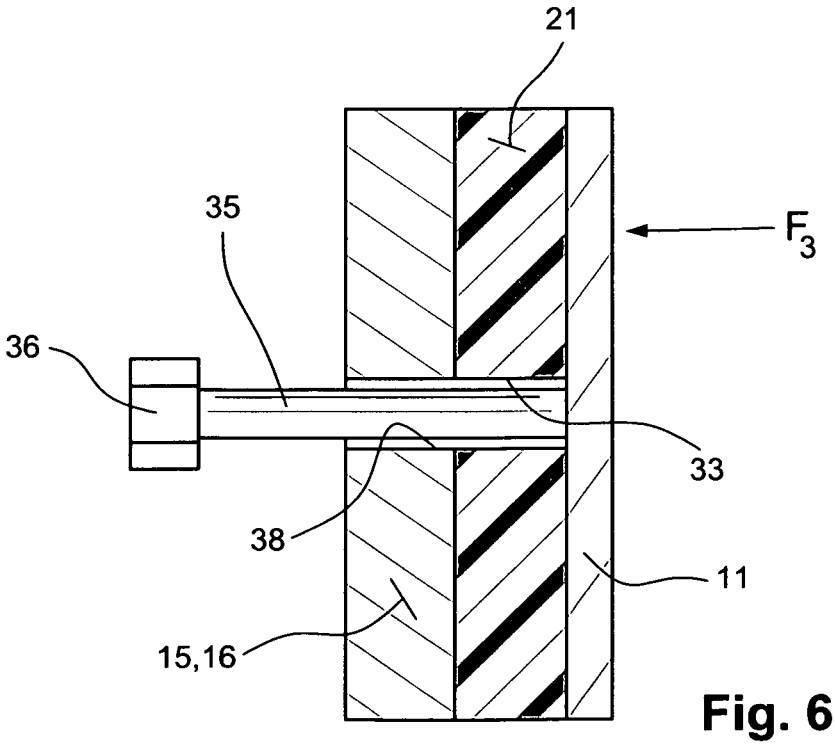
FIG. 6 is a view identical to that of FIG. 5 when an impact force $F_3$ causes compression of the dampening material.

While the board 11 may be operatively connected to the material 21 and frame elements 15, 16 by any suitable conventional or hereafter developed mechanism, FIGS. 5 and 6 show one desirable manner of connection, which also accommodates compression of the dampening material 21 and provides proper alignment of the components even during compression. In the FIGS. 5 & 6 embodiment, the dampening material 21 has a plurality (only one of which is shown, but which are provided wherever desirable at all portions of material 21) of openings 33 therein. A plurality of fasteners 34 are operatively connected to the dasher board 11 substantially in alignment with the openings 33, and passing therethrough. In the embodiment illustrated each fastener has a shaft 35 and a head 36. The shaft 35 may be connected by a recessed (in board 11) screw fastener, adhesive, ultrasonic welding, or any other suitable technique, to the board 11. The head 36 may be removable for ease of disassembly. For example the head 36 may be a nut and the cooperating end of shaft 35 screw-threaded.

As also shown in FIGS. 5 & 6 there are provided a plurality of openings 38 in the frame elements 15, 16 substantially in alignment with the dampening material openings 33, the fastener shafts 35 passing therethrough so as to be movable with respect to the frame elements 15, 16. FIG. 5 shows the components during normal conditions, and FIG. 6 shows the same components when a large impact force $F_3$ is applied thereto, the energy from the impact force absorbed by compression of the material 21.

While the fasteners 34 and cooperating openings 33, 38 are preferred, the material can be operatively connected to one or both of the board 11 and the frame elements 15, 16 by other suitable mechanisms, such as adhesive, ultrasonic welding, adhesive augmented laser or ultrasonic welding, or the like, as long as substantially free compression of the material 21 is provided at the same time that the elements 11, 15, 16 are operatively connected together.

Figure 7:
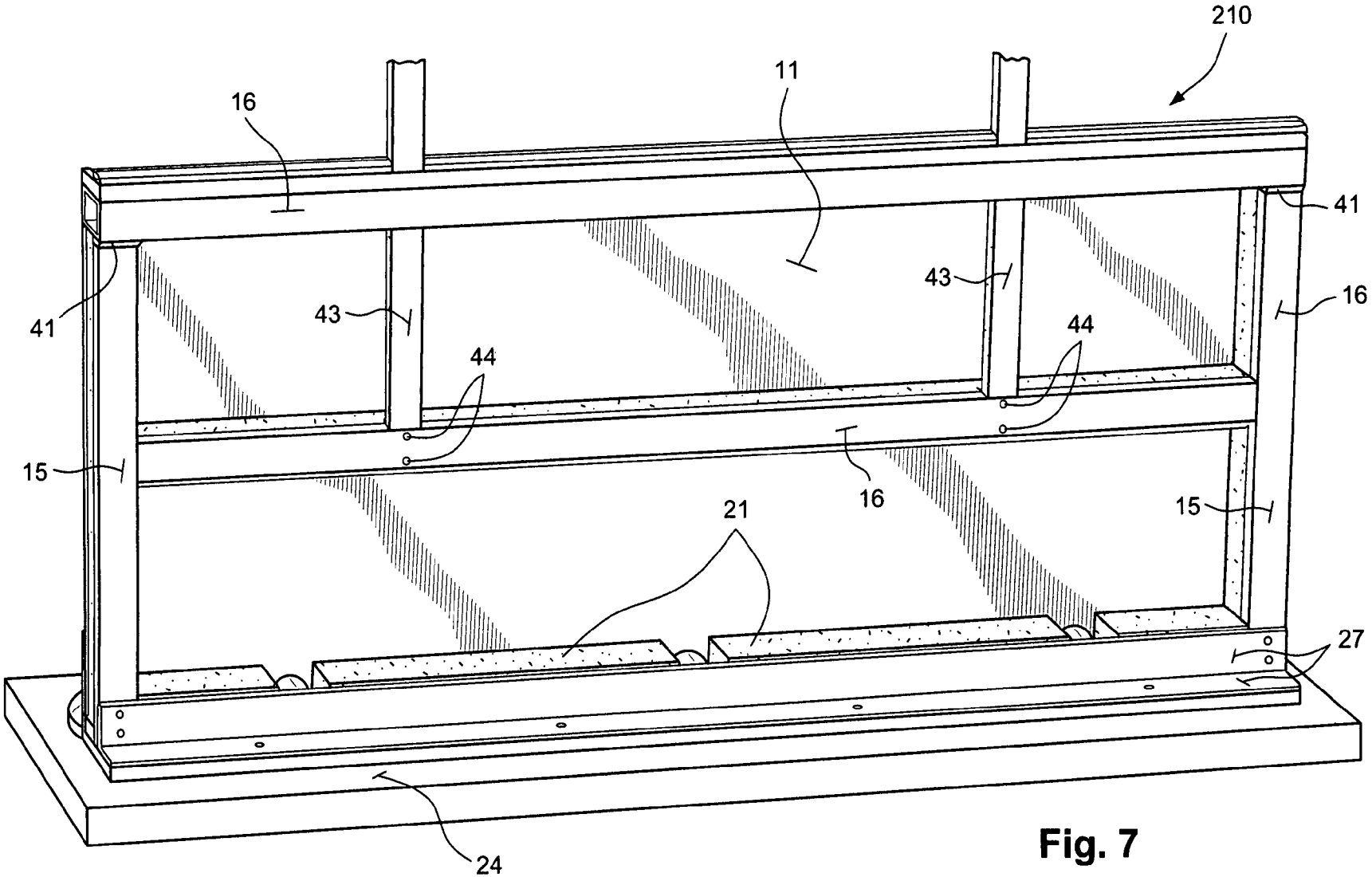
FIG. 7 is a primarily rear, slightly isometric, view of another exemplary embodiment of a dasher board frame assembly.

FIG. 7 shows a slightly different embodiment of a dasher board assembly, illustrated generically by reference numeral 210; components thereof the same as in the FIGS. 1 and 2 embodiments are shown by the same reference numerals.

The primary differences between the FIGS. 2 and 7 embodiments are the provision in FIG. 7 of fillet welds 41 where the side substantially vertical frame elements 15 are connected to the top substantially horizontal frame element 16 which overlies the tops of the elements 15, and the provision of two or more substantially vertical H-beam posts 43 that extend from the middle substantially horizontal frame element 16 up past the top element 16. The posts 43 hold the conventional transparent shielding panels (19 in FIG. 1) in place.

The posts 43 may be of aluminum, and connected by fasteners, shown schematically at 44 in FIG. 7, to the middle element 16. The fillet welds 41 may be provided at the back edge, inside edge, and front edge of the elements 15. In both the FIGS. 2 and 7 embodiments fillet welds (not referenced) may connect the middle frame element 16 to the side frame elements 15.

According to the present claimed invention, especially when the assemblies 10, 110, 210 are to be used for ice hockey rinks, it is highly desirable to provide other advantageous components to facilitate that use. A highly desirable Ice dam, kickplate, and puck rebound facilitator that may be utilized according to the invention are illustrated in FIG. 8.

FIG. 8 shows in more detail the ice dam 31 somewhat visible in FIG. 2. The ice dam 31 according to the invention is particularly constructed to properly keep water and ice inside a hockey or speed skating rink and help prevent leakage and ice buildup beyond the dasher board 11. Conventionally an ice dam is usually an HDPE or steel rectangular block located between the concrete floor 24 and an anchoring structure for the dasher board frame. However using such conventional structures a significant layer of ice can develop inside the boards 11, mostly from freezing condensate. The ice dam 31 minimizes this problem.

The advantageous ice dam 31 of the invention illustrated in FIG. 8 has two components, a main body component 46, and an ice-engagable lip 47, lip 47 underlying dasher board 11 (and kickplate 123) and component 46 underlying the frame. A dotted line 48 is illustrated in FIG. 8 just to show the interface between the component 46 and lip 47, but in this preferred embodiment the elements 46, 47 are a unitary piece of material, such as HDPE. However a dotted or solid line 49 or other indicia may be printed, painted, etched, or otherwise provided on the portion of the dam 31 in contact with ice to indicate the maximum level to which the rink should be filled with water/ice.

The lip 47 extends a significant distance above the top of the body component 46, as clearly seen in FIG. 8. The significant distance is typically between about ½-two ½ inches, most desirably about one inch. In addition to keeping the water/ice inside the rink so that it cannot move past board 11, the lip 47 also creates a sacrificial open space 50 beneath the dampening material 21 which allows any ice that may buildup due to condensation to have no practical effect on the functionality of the damping and energy absorbing functions of the material 21. The lip 47 also facilitates proper rebound of a puck from the assembly 10, 110, 210 since it provides rebound characteristics comparable to kickplates in existing commercial ice hockey rinks.

FIG. 8 also shows a kickplate 123 that performs the same function as conventional kickplates. The kickplate 123, like conventional kickplates, provides protection from skates and pucks hitting the side of the rink and it must exhibit the properties of high impact strength, abrasion-resistance, low coefficient of friction, moisture, stain and abrasion-resistance, and durability. The kickplate 123 may be made of high quality HDPE with UV stabilizers. As is conventional the kickplate 123 may be connected to the dasher board 11 by a plurality of screws (e.g. with recessed heads) 52 or other mechanical fasteners.

Because of the provision of the dampening material 21, the kickplate 123 may not exhibit the desired puck rebound characteristics for high level hockey. It is highly desirable for a puck to rebound from the kickplate 123 with a velocity at least 30-40% as high as its impact velocity. In order to facilitate this, according to the invention the assembly of FIG. 8 includes a plurality (only one of which is shown for clarity of illustration) of rebound facilitating structures 54 spaced at intervals along the length of the kickplate 23 and operatively disposed between the kickplate 123 and the upward leg of the anchoring device 27. The dampening material 21 is provided between structures 54.

The rebound facilitating structure 54 may comprise any device which has the dual functions of high energy absorption upon a relatively low speed and high mass impact (such as a hockey player or his/her equipment impacting a board 11 and/or kickplate 123) and minimal energy absorption upon impact of the kickplate 123 by a high speed low mass object (such as a puck). For example the structure 54 must act generally similarly to the dampening material 21 if a 175 pound hockey player travelling at 10 mph impacts the board 11 and/or kickplate 123, yet if a six ounce puck travelling at 100 mph impacts the kickplate 123 the structure 54 must act essentially like a rigid member and provide a rebound speed of at least 30-40 mph.

While any device having the functionality set forth above may be utilized the preferred embodiment of the puck rebound facilitating structure 54 according to the invention, as illustrated in FIG. 8, is a buckling elastomeric material tube. While a wide variety of materials may be utilized, one particularly desirable material comprises styrene butadiene rubber (SBR), selected for its modulus of elasticity, good flexural characteristics at low temperature, and low cost. In one embodiment the SBR tube 54 is substantially circular in cross section (though it could have other cross-sectional configurations, such as polygonal) and has a tube wall 55 about 0.17-0.25 inches thick (e. g. about 0.1875 inches), and an outer diameter 56 of about two ½ to three ½ inches (e. g. about three inches).

Utilizing the puck rebound facilitating structure 54, when a hockey player impacts the board 11 and kickplate 123 the tube 54 buckles and has energy absorption characteristics generally comparable to those of the dampening material 21. However when a puck at a high rate of speed impacts the kickplate 123 the structure 54 provides a more or less rigid backstop, causing the puck to rebound at at least about 30-40% of its impact velocity whereas if the structure 54 were not present it might rebound with less than 10% of its impact velocity.

Preferably a plurality of structures 54 are interspersed between sections of dampening material 21 behind the board 11 at or near the kickplate 123.

Figure 9:
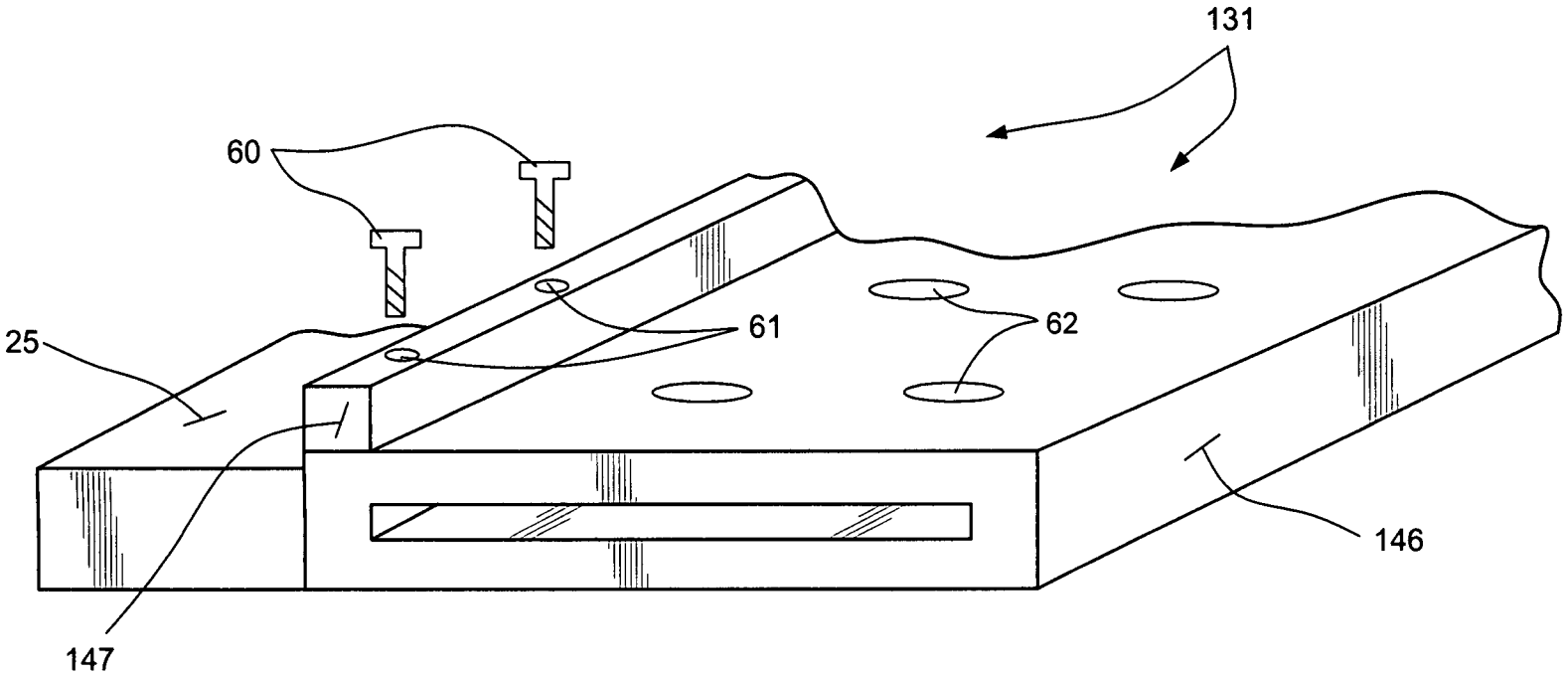
FIG. 9 is a schematic perspective view of an alternative configuration of ice dam to that illustrated in FIG. 8.

FIG. 9 shows an ice dam 131 according to the invention with an alternative construction to that of the ice dam 31 of FIGS. 2 and 8, with comparable structures shown by the same reference numeral only preceded by a "1." The ice dam 131 has the potential advantages of adjustability of ice thickness and material variety, while still providing the functionality of the beneficial ice dam 31.

The ice dam 131 has two distinct parts, a body component 146 and a lip 147, rather than being a unitary structure like the ice dam 31. The component 146 may be of any suitable .

material, such as a rectangular cross-section steel tube as illustrated in FIG. 9. Lips 147 (which also may be of steel, or other suitable material such as HDPE) of adjustable heights (e. g. from ½ to two ½ inches), depending upon the thickness of ice desired for a rink, may be provided. A lip 147 is connectable by a plurality of mechanical (e. g. screw) fasteners 60 to the component 146. The fasteners 60 may pass through openings 61 in lip 147 and screw into conventional threaded openings (not shown) in the body component 146. Other fasteners (not shown) may pass through openings 62 to attach body component 146 to a floor surface (24).

Figure 10:
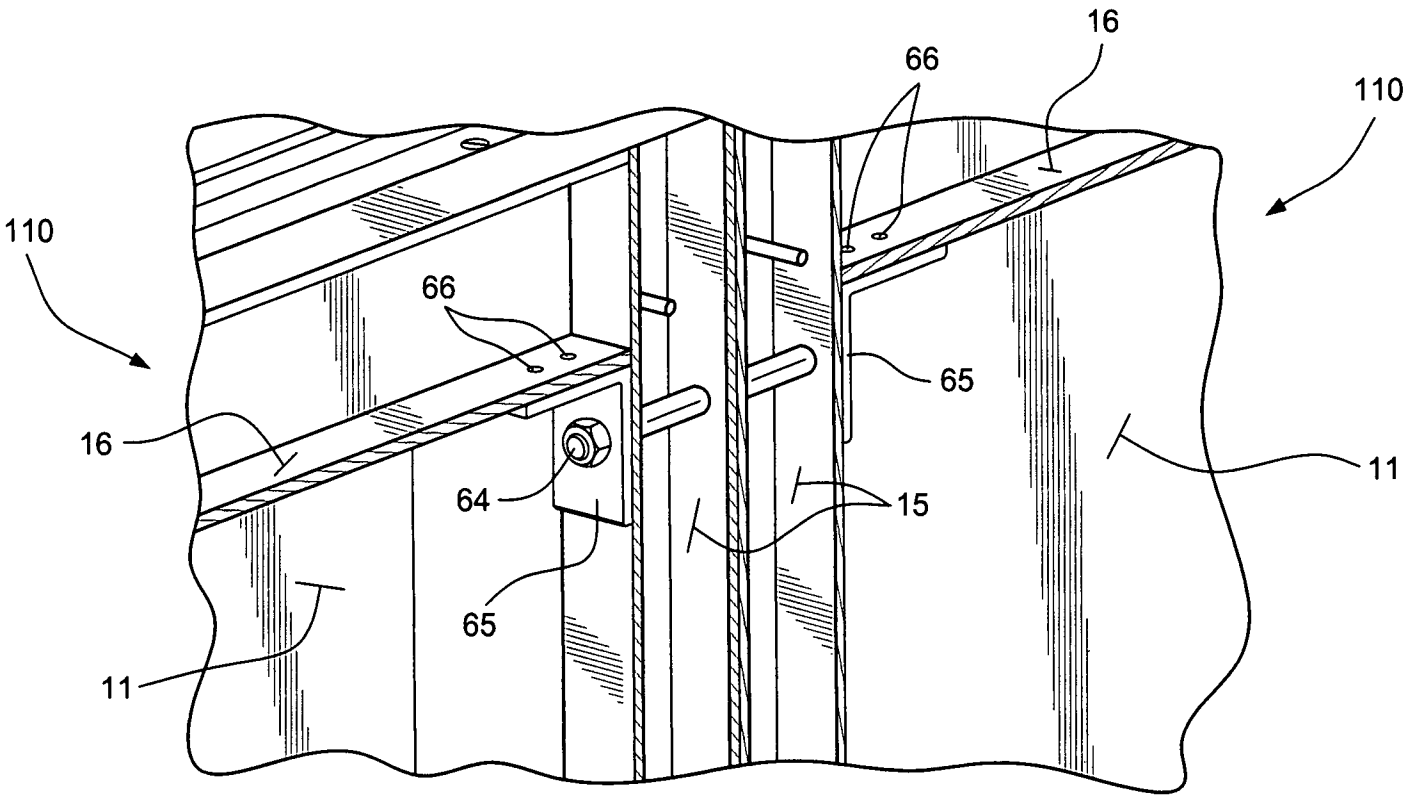
FIG. 10 is a schematic perspective view, partly in cross-section, of an exemplary manner of connecting together adjacent dasher board assemblies.

FIG. 10 illustrates one possible connection of adjacent dasher board assemblies 10, 110, 210 together. Conventionally dasher board assemblies are connected together at about the middle (vertically) of the boards. When cantilevered substantially vertical frame elements 15 as described above are utilized, however, it is desirable to fasten the adjacent board assemblies 10, 110, 210 together near the top, so that proper energy absorption will occur (to ensure alignment of the adjacent panels at the most significant location of cantilever action during a large impact).

In the exemplary embodiment of FIG. 10 a single bolt (e.g. ½ inch stainless steel) 64 passes through substantially vertical tubular frame elements 15 (shown in cross-section) on adjacent assemblies 110. Optionally L-brackets 65 may be provided. When brackets 65 are used the bolt 64 passes through one leg of each L-bracket 65 while the other leg is connected (e. g. by screws 66) to a substantially horizontal frame element 16. Conventional gussets (not shown) may be used instead of brackets 65.

All narrow ranges within a broad numerical range set forth above are also specifically included herein. For example a range of about three-five inches includes 2.95-3.82 inches, 3.71-5.04 inches, and all other narrow ranges within the broad range.

While the invention has been shown and described in what is presently conceived to be the preferred embodiment thereof it is to be understood that many modifications are possible within the scope of the invention. Therefore the invention is to be accorded the broadest interpretation possible, limited only by the prior art, so as to encompass all equivalent structures and devices.

What is claimed is:

1. A dasher board assembly for an ice hockey rink or the like comprising:

a frame including a plurality of substantially vertical frame elements and a plurality of substantially horizontal frame elements;

at least one substantially rigid dasher board operatively connected to said vertical and horizontal frame elements, said dasher board having a top area and bottom area;

a kickplate operatively connected to said dashboard at said bottom area on the opposite side of said board from said frame;

a dampening material operatively provided between said dasher board and said frame elements; and a puck rebound facilitating structure operatively engaging said dasher board at the general area of said kickplate which exhibits the dual functions of high energy absorption upon impact of said dasher board by a high mass object at a relatively low speed and minimal energy absorption upon impact of the kickplate by a hockey puck.

2. An assembly as recited in claim 1 wherein said puck rebound facilitating structure exhibits sufficient rigidity when a puck impacts said kickplate to cause the puck to rebound with a velocity of at least 30% of its impact velocity.

3. An assembly as recited in claim 2 wherein said structure comprises a buckling elastomeric tube, a plurality of such tubes being disposed at spaced locations along said kickplate.

4. An assembly as recited in claim 3 wherein said buckling elastomeric tube comprises an SBR tube with a tube wall thickness of about 0.17-0.25 inches and a substantially circular cross-section with an outside diameter of about 2.5-3.5 inches.

5. An assembly as recited in claim 3 wherein said dampening material has at least one of a damping coefficient of about $1.7\text{-}3.2\times10^4$ N–s/m, a spring constant of about $1.5\text{-}3.0\times10^6$ N/m, and a loss coefficient >0.15; and wherein said buckling elastomeric tube has generally comparable damping values when said board is impacted by a high mass object at relatively low speed.

6. An assembly as recited in claim 1 further comprising a rigid unitary L-shaped anchoring device for said frame having a substantially horizontal leg operatively connected to a stationary surface and a substantially upright leg operatively connected to at least two of said frame substantially vertical elements.

7. An assembly as recited in claim 1 further comprising an ice dam provided at or adjacent said dasher board bottom area, said ice dam comprising a main body component and an ice-engagable lip extending upwardly a significant distance from said main body component, said lip underlying said dasher board and said frame.

8. An assembly as recited in claim 7 wherein said significant distance is between about ½ and two ½ inches.

9. An assembly as recited in claim 8 further comprising indicia on said ice dam adapted to face the interior of an ice rink, said indicia indicating a water/ice fill level.

10. An assembly as recited in claim 7 wherein said ice dam has a unitary construction.

11. An assembly as recited in claim 7 wherein said lip and said main body component comprise two separable elements, held together with mechanical fasteners.

* * * * *